US008307678B2

(12) United States Patent
Tachibana

(10) Patent No.: US 8,307,678 B2
(45) Date of Patent: Nov. 13, 2012

(54) GAUGE CONTROL APPARATUS

(75) Inventor: Minoru Tachibana, Tokyo (JP)

(73) Assignee: Toshiba Mitsubishi-Electric Industrial Systems Corporation, Tokyo (JP)

( * ) Notice: Subject to any disclaimer, the term of this patent is extended or adjusted under 35 U.S.C. 154(b) by 549 days.

(21) Appl. No.: 12/670,134

(22) PCT Filed: Sep. 20, 2007

(86) PCT No.: PCT/JP2007/068246

§ 371 (c)(1),
(2), (4) Date: Jan. 22, 2010

(87) PCT Pub. No.: WO2009/037766

PCT Pub. Date: Mar. 26, 2009

(65) Prior Publication Data

US 2010/0192654 A1 Aug. 5, 2010

(51) Int. Cl.
*B21B 37/18* (2006.01)
*B21B 1/36* (2006.01)

(52) U.S. Cl. ..... 72/8.1; 72/9.2; 72/10.1; 72/10.3; 72/10.4; 72/10.7; 72/13.4; 72/245; 72/365.2

(58) Field of Classification Search ..... 72/8.1, 72/8.9, 9.2, 10.1, 10.3, 10.4, 10.6, 10.7, 13.4, 72/245, 365.2, 366.2
See application file for complete search history.

(56) References Cited

U.S. PATENT DOCUMENTS 3,574,279 A * 4/1971 Smith, Jr. ..... 72/10.4
3,802,236 A * 4/1974 Smith et al. ..... 72/11.8
3,803,886 A * 4/1974 Sterrett et al. ..... 72/10.6
4,093,321 A * 6/1978 Ikariishi et al. ..... 384/447
5,204,889 A * 4/1993 Kraybill ..... 378/54
5,414,619 A * 5/1995 Katayama et al. ..... 700/31

FOREIGN PATENT DOCUMENTS

| | | | |
|---|---|---|---|
| JP | 47-28593 | B1 | 7/1972 |
| JP | 58-212806 | A | 12/1983 |
| JP | 5-337531 | A | 12/1993 |
| JP | 6-246323 | A | 9/1994 |
| JP | 7-51713 | A | 2/1995 |
| JP | 9-85317 | A | 3/1997 |
| JP | 2003-211210 | A | 7/2003 |

* cited by examiner

*Primary Examiner* — David B Jones
(74) *Attorney, Agent, or Firm* — Leydig, Voit & Mayer, Ltd.

(57) ABSTRACT

A gauge control apparatus reduces deviation of an actual plate thickness from a target plate thickness on the delivery side of a rolling mill, in all speed ranges, and produces good products by controlling plate thickness considering changes in the oil film thickness of oil film bearings of backup rolls and the deformation resistance of a rolled material with respect to rolling speeds. The gauge control apparatus computes an oil film thickness compensation value to compensate for increase and decrease of the gap resulting from a change in thickness of the oil film bearing attributable to rolling speeds, an acceleration compensation value to compensate for increase and decrease of plate thickness on the delivery side of the rolling mill resulting from a change in deformation resistance of the rolled material attributable to rolling speeds, and deviation of the predicted plate thickness from the target plate thickness, in consideration of the computed compensation values.

4 Claims, 4 Drawing Sheets

GAUGE CONTROL APPARATUS

TECHNICAL FIELD

The present invention relates to a gauge control apparatus that controls a rolled material rolled by a rolling mill to a prescribed target plate thickness.

BACKGROUND ART

In a rolling mill which rolls a material to be rolled, the plate thickness accuracy on the delivery side of the rolling mill is a great factor which has an influence on the quality of products. It is known that in such a rolling technique a change in the oil film thickness of oil film bearings of backup rolls exerts an influence on the plate thickness accuracy on the delivery side of the rolling mill. For this reason, in order to improve the plate thickness accuracy on the delivery side of the rolling mill, techniques for compensating for a plate thickness change on the delivery side of the rolling mill resulting from the above-described oil film thickness of the oil film bearings have hitherto been studied.

For example, as conventional arts there have been proposed techniques for determining rolling position in consideration of the oil film thickness of oil film bearings in order to cause the plate thickness on the delivery side of the rolling mill to approach a target plate thickness (refer to Patent Document 1, for example).

Patent Document 1: Japanese Patent Laid-Open No. 58-212806

DISCLOSURE OF THE INVENTION

Problems to be Solved by the Invention

Although plate thickness control in which the oil film thickness of oil film bearings is considered is performed in the technique described in Patent Document 1, no consideration is given to a change in the oil film thickness or a change in the deformation resistance of a rolled material due to rolling speeds during the plate thickness control. For this reason, this posed the problem that the quality of products worsens when the rolling speed changes.

The present invention has been made to solve problems as described above, and the object of the invention is to provide a gauge control apparatus that can reduce a deviation of an actual plate thickness from a target plate thickness on the delivery side of the rolling mill in all speed ranges and can produce good products by performing plate thickness control in consideration of changes in the oil film thickness of oil film bearings of backup rolls and in the deformation resistance of a rolled material with respect to rolling speeds.

Means for Solving the Problems

A gauge control apparatus of a rolling mill of the present invention is a gauge control apparatus which controls a rolled material rolled by a rolling mill to a prescribed target plate thickness, and which comprises top and bottom work rolls which roll the rolled material, top and bottom backup rolls which come into contact with the top and bottom work rolls from above and from below and which are each rotatably supported by an oil film bearing, a load measuring device which measures loads applied to the rolling mill, a gap measuring device which measures a gap formed between the top and bottom work rolls, a rolling speed measuring device which measures rolling speeds, and an automatic gauge control device which controls the gap so as to cause a plate thickness of the rolled material on the delivery side of the rolling mill to approach the target plate thickness on the basis of a predicted plate thickness calculated by a prescribed plate thickness computing expression and the target plate thickness. Also, the automatic gauge control device comprises an oil film thickness compensation value computing section which computes an oil film thickness compensation value of the gap relative to rolling speeds on the basis of measurement results of the rolling speed measuring device in order to compensate for an increase and decrease of the gap resulting from a change in an oil film thickness of the oil film bearing ascribed to rolling speeds, an acceleration compensation value computing section which computes an acceleration compensation value of a plate thickness on the delivery side of the rolling mill relative to rolling speeds on the basis of measurement results of the rolling speed measuring device in order to compensate for an increase and decrease of a plate thickness on the delivery side of the rolling mill resulting from a change in deformation resistance of the rolled material ascribed to rolling speeds, and a deviation computing section which computes a deviation of the predicted plate thickness from the target plate thickness on the basis of measurement results of the load measuring device and the gap measuring device as well as a mill modulus of the rolling mill, the oil film thickness compensation value and the acceleration compensation value, which have been computed.

Effect of the Invention

According to the present invention, by performing plate thickness control in consideration of changes in the oil film thickness of oil film bearings of backup rolls and in the deformation resistance of a rolled material with respect to rolling speeds, it is possible to reduce a deviation of an actual plate thickness from a target plate thickness on the delivery side of the rolling mill in all speed ranges and hence it becomes possible to produce good products.

BRIEF OF DESCRIPTION OF THE DRAWINGS

DESCRIPTION OF SYMBOLS 1 rolled material,
2 top work roll,
3 bottom work roll,
4 top backup roll,
5 bottom backup roll,
6 oil film bearing,
7 lubricating oil,
8 shaft,
9 roll surface,
10 shaft,
11 roll surface, -continued 12 load measuring device,
13 automatic gauge control device,
14 oil film thickness compensation value computing section,
15 bender compensation value computing section,
16 acceleration compensation value computing section,
17 deviation computing section

BEST MODE FOR CARRYING OUT THE INVENTION

The present invention will be described in more detail with reference to the accompanying drawings. Incidentally, in each of the drawings, like numerals refer to like or similar parts and overlaps of description of these parts are appropriately simplified or omitted.

FIRST EMBODIMENT

Figure 1:
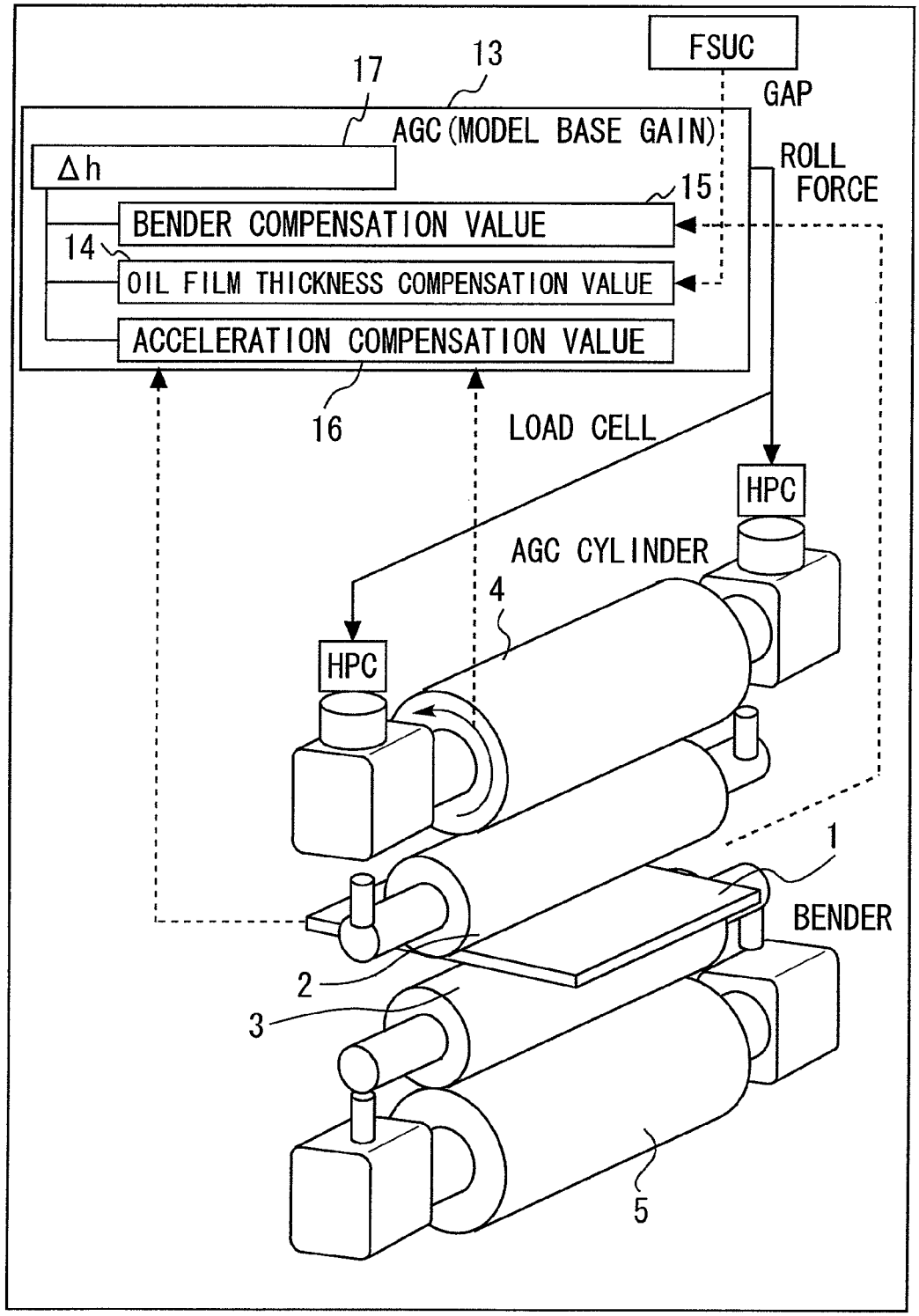
FIG. 1 is a block diagram showing a gauge control apparatus in First Embodiment according to the present invention.
Figure 2:
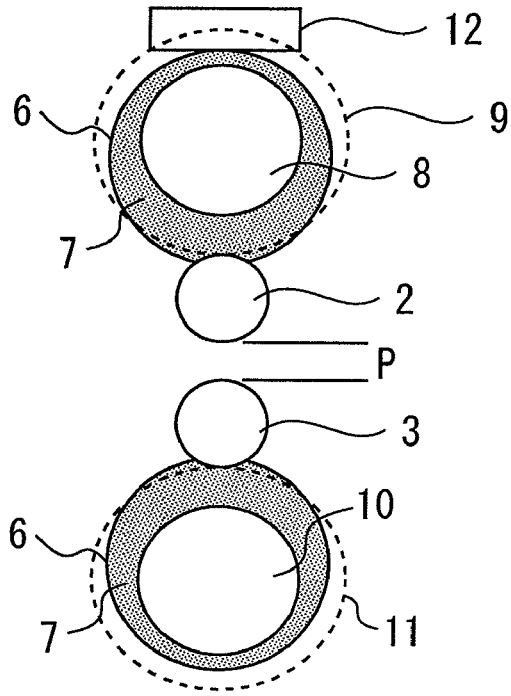
FIG. 2 is a diagram showing a rolling mill before acceleration.
Figure 3:
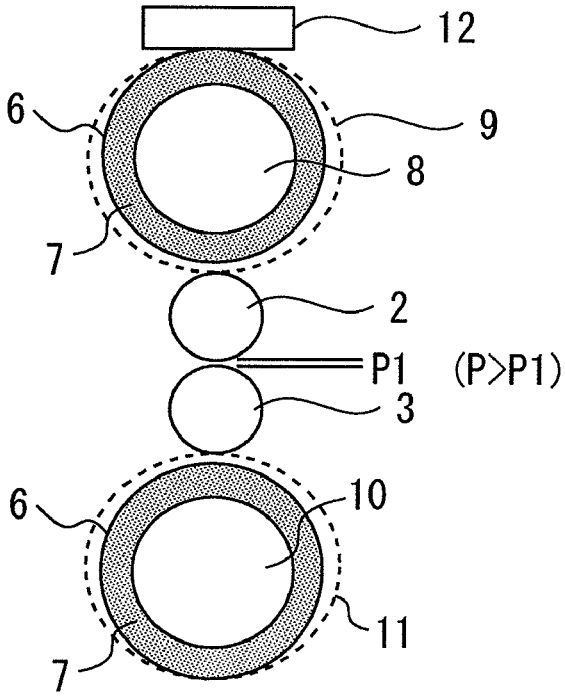
FIG. 3 is a diagram showing the rolling mill during acceleration.
Figure 4:
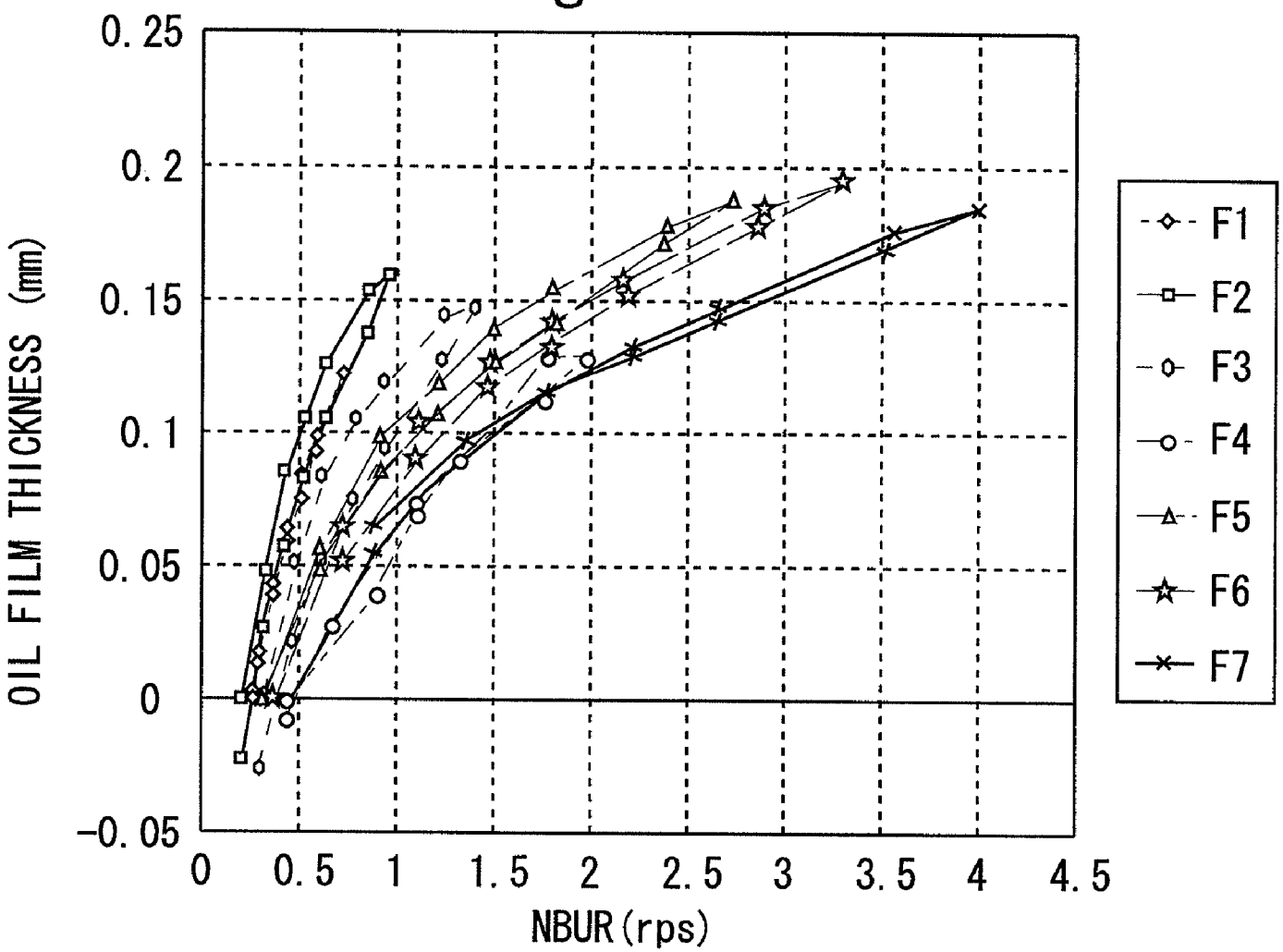
FIG. 4 is a diagram showing the relationship between roll speed and the oil film thickness of an oil film bearing.
Figure 5:
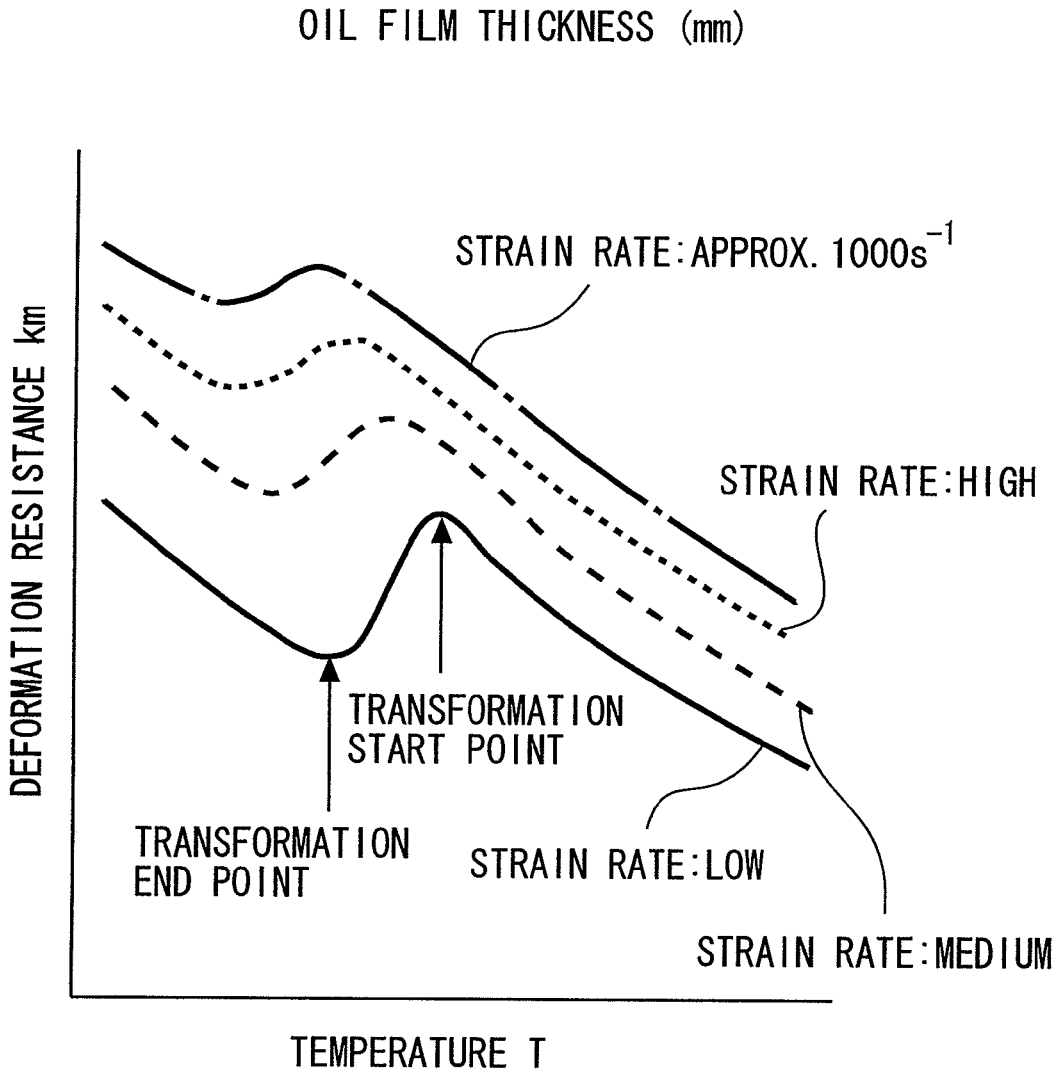
FIG. 5 is a diagram showing the relationship between deformation velocity and deformation resistance.

FIG. 1 is a block diagram showing a gauge control apparatus in First Embodiment according to the present invention. FIG. 2 is a diagram showing a rolling mill before acceleration. FIG. 3 is a diagram showing the rolling mill during acceleration. FIG. 4 is a diagram showing the relationship between roll speed and the oil film thickness of an oil film bearing. FIG. 5 is a diagram showing the relationship between deformation velocity and deformation resistance.

In FIGS. 1 to 5, reference numeral 1 denotes a rolled material consisting of a metal material rolled by a rolling mill and the like; reference numeral 2 denotes a top work roll; and reference numeral 3 denotes a bottom work roll. The rolled material 1 is rolled by the top and bottom work rolls 2 and 3 from above and from below. Reference numeral 4 denotes a top backup roll which comes into contact with the top work roll 2 from above; and reference numeral 5 denotes a bottom backup roll which comes into contact with the bottom work roll 3 from below. The top and bottom backup rolls 4 and 5 are each rotatably supported by oil film bearings 6. Incidentally, reference numeral 7 denotes a lubricating oil in each of the oil film bearings 6; reference numeral 8 denotes a shaft of the top backup roll 4; reference numeral 9 denotes a roll surface of the top backup roll 4; reference numeral 10 denotes a shaft of the bottom backup roll 5; and reference numeral 11 denotes a roll surface of the bottom backup roll 5.

The gauge control apparatus shown in FIG. 1 is provided with a hydraulic roll gap control device, a bender pressure control device for controlling the crown shape in good condition, a load measuring device 12 for measuring loads applied to the rolling mill, a gap measuring device which measures a roll gap P formed between the top and bottom work rolls 2 and 3, a rolling speed measuring device which measures rolling speeds, i.e., roll speeds, an automatic gauge control device (AGC) 13 and the like.

The automatic gauge control device 13 controls the above-described roll gap P so as to cause a plate thickness of the rolled material 1 on the delivery side of the rolling mill to approach the above-described target plate thickness on the basis of a predicted plate thickness calculated by a prescribed plate thickness computing expression and a prescribed target plate thickness. The automatic gauge control device 13 is provided with, for example, an oil film thickness compensation value computing section 14 which computes an oil film thickness compensation value, a bender compensation value computing section 15 which computes a bender compensation value, an acceleration compensation value computing section 16 which computes an acceleration compensation value, and a deviation computing section 17 which computes a deviation of a predicted plate thickness value from a target plate thickness.

The oil film thickness compensation value is intended for compensating for an increase and decrease in the roll gap P which are generated when the oil film thickness of the oil film bearing 6 changes due to rolling speeds. The above-described oil film thickness compensation value computing section 14 computes an oil film thickness compensation value of the roll gap P relative to rolling speeds on the basis of measurement results of the rolling speed measuring device. The bender compensation value is intended for compensating for a difference between loads applied to the top and bottom work rolls 2 and 3 and loads applied on the rolled material 1. The acceleration compensation value is intended for compensating for an increase and decrease in a plate thickness on the delivery side of the rolling mill which occur when the deformation resistance of the rolled material 1 changes due to rolling speeds. The above-described acceleration compensation value computing section 16 computes an acceleration compensation value of a plate thickness on the delivery side of the rolling mill relative to rolling speeds on the basis of measurement results of the rolling speed measuring device.

And the deviation computing section 17 computes a deviation of a predicted plate thickness from a target plate thickness on the basis of measurement results of the load measuring device 12 and the gap measuring device as well as a mill modulus of the rolling mill, the oil film thickness compensation value, the bender compensation value and the acceleration compensation value, which have been computed.

In the following, specifics of the automatic gauge control device 13 will be described.

A predicted plate thickness on the delivery side of the rolling mill has hitherto been found by the following expression:

$$h_n = F_n / M_n + S \tag{1}$$

where, h: Plate thickness on the delivery side of the rolling mill, F: Load applied to the rolling mill, M: Modulus of elasticity of the mill (mill modulus), n: Number of mill stands, S: GAP FBK. In expression (1) above, only the load F applied to the rolling mill and the mill modulus M are taken into consideration in the calculation of a predicted plate thickness. That is, no consideration was given to the lubricating oil 7 of the oil film bearing 6.

In actuality, however, as shown in FIGS. 2 and 3, the lubricating oil 7 covers the whole of the shafts 8 and 10 when the roll rotation is accelerated. That is, the top and bottom backup rolls 4 and 5 move so that the thickness of the oil films formed around the shafts 8 and 10 becomes uniform. For this reason, from the condition shown in FIG. 2 the top backup roll 4 moves downward and the bottom backup roll 5 moves upward, with the result that the roll gap P becomes closed (see FIG. 3). As a result, during the acceleration of the roll rotation, the load F applied to the rolling mill increases compared to the load before the acceleration. On the other hand, the delivery thickness in an actual material is constant regardless of acceleration.

According to expression (1) above, it is recognized that when the load applied to the rolling mill increases, with GAP FBK kept constant, the plate thickness h on the delivery side of the rolling mill increases. In conventional plate thickness control in hot finishing rolling mills, control has been carried out on the basis of expression (1) and, therefore, control for closing the roll gap has been carried out when the rolling speed increases. Therefore, this posed the problem that the roll gap is closed although the thickness of an actual material is constant, with the result that the actual material on the delivery side of the rolling mill becomes thin.

Hence, in the above-described automatic gauge control device 13, to compensate for the above-described closing amount of roll gap due to acceleration, the oil film thickness compensation value computing section 14 is caused to store beforehand a prescribed function for calculating an oil film thickness compensation value. Incidentally, in this function, rolling speed is used as a variable and this function is prepared so that an output value increases with increasing rolling speed. And the deviation computing section 17 calculates a predicted plate thickness by deducting an oil film thickness compensation value obtained on the basis of measurement results of the rolling speed measuring device from a plate thickness obtained on the basis of measurement results of the load measuring device 12 and the gap measuring device as well as a mill modulus. As is apparent from the foregoing, it is possible to reduce a difference between a predicted plate thickness and an actual plate thickness on the delivery side of the rolling mill.

Concretely, to find a function for deriving the above-described oil film thickness compensation value, with the roll gap P set in such a mariner that the load applied to the rolling mill obtains a prescribed value, the rotation number of the backup rolls 4 and 5 is changed from a low-speed rage to a high-speed range and vice versa from a high-speed range to a low-speed range and a change in load occurring at that time is measured. Furthermore, by changing the load applied to the rolling mill, loads generated when the rolling speed is accelerated and decelerated are measured in the same manner as described above (see FIG. 4). And the relationship between the roll rotation number (rolling speed) and the closing amount of roll gap is derived by dividing the function of rolling speed and load obtained by the measurement by the mill modulus. Incidentally, it is known that the oil film thickness is related to the roll speed. Therefore, the above-described function of the automatic gauge control device 13 is realized by adopting the derived function described above as an oil film thickness compensation value.

In general, in a rolling mill, control for improving crown shape is performed by use of work roll benders provided in the work rolls 2 and 3. Therefore, the load applied to a roll changes due to a change in the work roll bending force. For example, when the work roll bending force is increased for the purpose of center elongation, the load applied to the roll decreases because the roll is lifted up. In actuality, however, because also the load of the work roll bender is applied to the material, the load applied to the roll differs from the load applied to the material. Therefore, to compensate for this difference, the bender compensation value computing section 15 performs compensation by which the load generated by a change in the work roll bending force is deducted from the load applied to the roll.

The automatic gauge control device 13 carries out calculations of a predicted plate thickness on the delivery side of the rolling mill by the following expressions:

$$F_Bc=Fb+Fb_{SET}$$

$$S_{oilc}=S_{oil}+S_{oil0}$$

$$S_m=(F-F_Bc)/M-S_{oilc}$$

$$h=+S \tag{2}$$

where, Fb: Work roll bending force [N], $Fb_{sET}$: Work roll bending force setting value [N], $F_Bc$: Work roll bending force compensation value [mm], $S_{oil}$: Oil film thickness [mm], $S_{oil0}$: Oil film thickness in zeroing [mm], $S_{oilc}$: Oil film thickness compensation value [mm], $S_m$: Mill stretch in zeroing [mm], h: Delivery thickness (gauge meter thickness) [mm], M: Mill modulus (mill stiffness) [N/mm].

When the rolling speed is increased, the speed at which the material is reduced in thickness by the rolling mill increases. That is, as shown in FIG. 5, when the rolling speed increases, the strain rate increases and deformation resistance increases. Because an increase in deformation resistance has the same meaning as an increase in mill modulus, when deformation resistance increases an actual plate thickness on the delivery side of the rolling mill becomes small. On the other hand, even when deformation resistance increases, this increase is not reflected in the actual load and actual roll gap used in expression (1).

That is, although there is no change in a plate thickness on the delivery side of the rolling mill which is derived using expression (1), an actual plate thickness (a real plate thickness) on the delivery side of the rolling mill becomes small and a deviation of a real plate thickness from a target plate thickness increases. To compensate for this plate thickness deviation due to rolling speeds, the automatic gauge control device 13 adds a function of rolling speed and roll gap opening as a compensation amount of plate thickness control.

In general, plate thickness control in a rolling mill is performed by controlling the roll gap P so that the following equation becomes 0.

$$\Delta h=h-h(\text{target value}) \tag{3}$$

where Δh: Plate thickness deviation.

However, as described above, when the rolling speed increases, the strain rate increases and deformation resistance increases. For this reason, when the rolling speed increases, an actual plate thickness h becomes small and actual Δh increases as positive values.

However, because a plate thickness on the delivery side of the rolling mill is larger than a target value in automatic gauge control, the automatic gauge control device 13 outputs a command to cause the roll gap P to be closed. That is, although an actual plate thickness on the delivery side of the rolling mill is thinner than a target plate thickness, control is performed in such a manner that the plate thickness is further reduced.

Incidentally, because the above-described plate thickness variation is caused by a change in mill stiffness due to rolling speeds, essentially, it is necessary to add compensation by speed to the gauge meter plate thickness computing expression. However, because of high rolling speeds, the response may be late if control is performed for compensated gauge meter plate thickness computations.

Hence, to compensate for the above-described plate thickness variation due to acceleration, in the automatic gauge control device 13, the acceleration compensation value computing section 16 is caused to store beforehand a prescribed function f(v) for calculating an acceleration compensation value. Incidentally, in this function, rolling speed is used as a variable and this function is prepared so that an output value increases with increasing rolling speed. And after calculating a predicted plate thickness without using an acceleration compensation value, the deviation computing section 17 calculates a plate thickness deviation Δh by adding an acceleration compensation value obtained on the basis of measurement results of the rolling speed measuring device to a value obtained by deducting a target plate thickness from this predicted plate thickness.

$$\Delta h=h-h(\text{target value})+f(v) \tag{4}$$

The automatic gauge control device 13 controls the roll gap P so that the plate thickness deviation Δh obtained by expression (4) approaches 0.

According to First Embodiment of the present invention, by performing plate thickness control in consideration of changes in the oil film thickness of the oil film bearings 6 of the backup rolls 4 and 5 and in the deformation resistance of the rolled material 1 due to rolling speeds, it is possible to reduce a deviation of an actual plate thickness from a target plate thickness on the delivery side of the rolling mill in all speed ranges and hence it becomes possible to produce good products.

That is, by using oil film compensation and acceleration compensation in combination, it is possible to constantly realize optimum plate thickness control regardless of whether high-speed rolling or low-speed rolling is performed and hence it becomes possible to improve plate thickness accuracy.

INDUSTRIAL APPLICABILITY

As described above, according to the gauge control apparatus related to the present invention, it becomes possible to perform optimum plate thickness control in all speed ranges by using oil film compensation and acceleration compensation in combination. Therefore, regardless of whether high-speed rolling or low-speed rolling is performed, it is possible to apply the present invention to automatic gauge control (AGC) in both hot rolling and cold rolling.

The invention claimed is:

1. A gauge control apparatus which controls a rolled material rolled by a rolling mill to target plate thickness, comprising:

top and bottom work rolls which roll the rolled material;

top and bottom backup rolls which respectively contact the top and bottom work rolls from above and from below and which are each rotatably supported by an oil film bearing;

a load measuring device which measures loads applied to the rolling mill;

a gap measuring device which measures a gap between the top and bottom work rolls;

a rolling speed measuring device which measures rolling speeds; and an automatic gauge control device which controls the gap to cause plate thickness of the rolled material on a delivery side of the rolling mill to approach the target plate thickness based on a predicted plate thickness calculated using a plate thickness computing expression and the target plate thickness, the automatic gauge control device comprising:

an oil film thickness compensation value computing section which computes an oil film thickness compensation value of the gap relative to rolling speeds based on measurement results of the rolling speed measuring device to compensate for increase and decrease of the gap resulting from a change in oil film thicknesses of the oil film bearings, which is attributable to rolling speeds, an acceleration compensation value computing section which computes an acceleration compensation value of plate thickness on the delivery side of the rolling mill relative to rolling speeds based on measurement results of the rolling speed measuring device to compensate for increase and decrease of plate thickness on the delivery side of the rolling mill resulting from a change in deformation resistance of the rolled material which is attributable to rolling speeds, and a deviation computing section which computes deviation of the predicted plate thickness from the target plate thickness based on measurement results of the load measuring device and the gap measuring device, and a mill modulus of the rolling mill, the oil film thickness compensation value, and the acceleration compensation value, which have been computed.

2. The gauge control apparatus according to claim 1, wherein the oil thickness compensation value is calculated using a function in which an output value increases with increasing rolling speed; and the deviation computing section calculates the predicted plate thickness by subtracting the oil film thickness compensation value, obtained on based measurement results of the rolling speed measuring device, from plate thickness, obtained based on measurement results of the load measuring device and the gap measuring device, and the mill modulus of the rolling mill.

3. The gauge control apparatus according to claim 1, wherein the acceleration compensation value is calculated using a function in which an output value increases with increasing rolling speed; and the deviation computing section calculates deviation of the predicted plate thickness from the target plate thickness by adding the acceleration compensation value, obtained based on measurement results of the rolling speed measuring device, to a value obtained by subtracting the target plate thickness from the predicted plate thickness.

4. The gauge control apparatus according to claim 2, wherein the acceleration compensation value is calculated using a function in which an output value increases with increasing rolling speed; and the deviation computing section calculates deviation of the predicted plate thickness from the target plate thickness by adding the acceleration compensation value, obtained based on measurement results of the rolling speed measuring device, to a value obtained by subtracting the target plate thickness from the predicted plate thickness.

* * * * *